United States Patent [19]

Felter

[11] 4,108,580

[45] Aug. 22, 1978

[54] ATTIC FANS

[76] Inventor: John V. Felter, P.O. Box 7464, Houston, Tex. 77008

[21] Appl. No.: 748,417

[22] Filed: Dec. 8, 1976

[51] Int. Cl.[2] ..... F04B 35/04

[52] U.S. Cl. ..... 417/362; 416/60

[58] Field of Search ..... 417/362, 363; 416/60, 416/174, 214

[56] References Cited

U.S. PATENT DOCUMENTS

| | | | |
|---|---|---|---|
| 1,023,272 | 4/1912 | Oakes | 416/174 |
| 2,198,420 | 4/1940 | Winton | 417/362 X |
| 2,975,961 | 3/1961 | Rodick | 417/362 |
| 3,044,689 | 7/1962 | Alldritt et al. | 417/362 |
| 3,190,543 | 6/1965 | Goettl | 417/362 X |
| 3,898,019 | 8/1975 | Reznick et al. | 417/362 |

FOREIGN PATENT DOCUMENTS

| | | | |
|---|---|---|---|
| 2,448,623 | 4/1976 | Fed. Rep. of Germany | 417/362 |

*Primary Examiner*—Carlton R. Croyle
*Assistant Examiner*—R. E. Gluck
*Attorney, Agent, or Firm*—Carl B. Fox, Jr.

[57] ABSTRACT

Attic fans of improved and economical design, wherein the blade hub, which in conventional attic fans is a cast hub is eliminated, and wherein the pulley on the blade shaft is eliminated.

19 Claims, 4 Drawing Figures

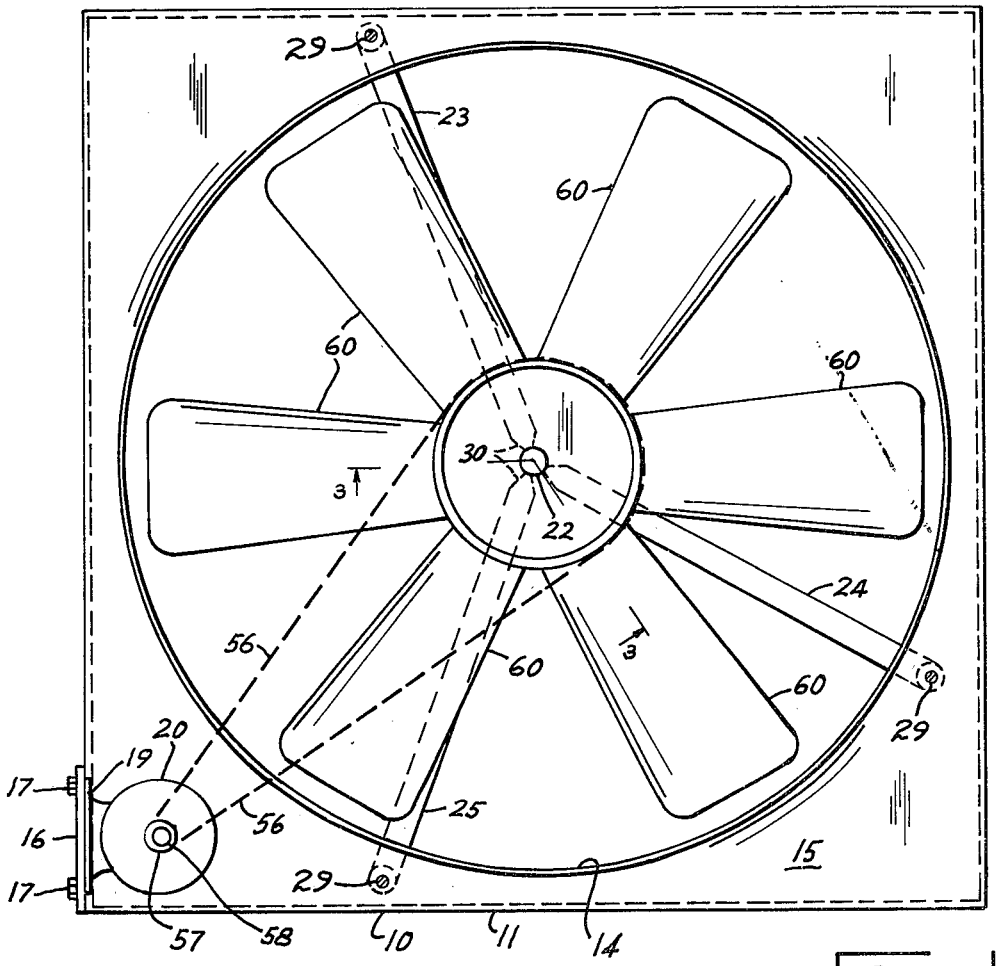
Fig. 1
Fig. 2
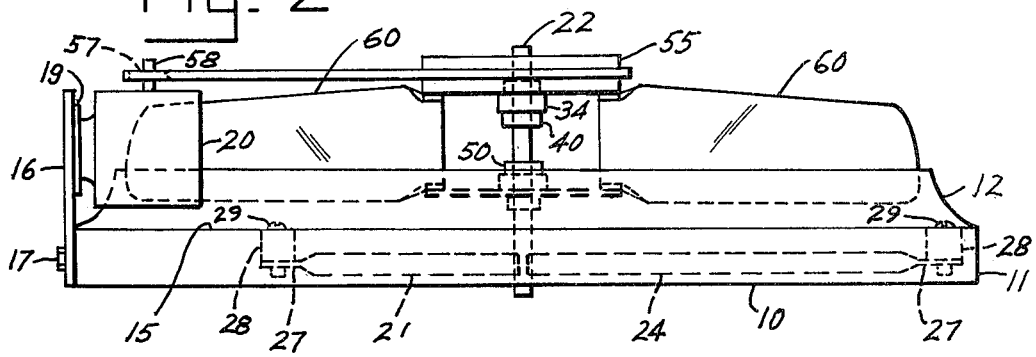

ATTIC FANS

BACKGROUND OF THE INVENTION

Conventional attic fans, of the type which exhaust air through the ceiling of a house or building interior into the attic, have a flat box-like frame or housing having a large central opening which has an upwardly curved rim or flange therearound. The blades, usually four in number, are connected to a rotating shaft below a cast hub which is supported by rods, usually three or four in number, which depend from the housing around the central opening and are inwardly bent above the opening to be connected to the hub at their inner ends. A pulley is carried by the blade shaft above the hub. An electric motor having its shaft disposed vertically is supported by the housing, and a drive belt is disposed around the motor pulley and the pulley on the blade shaft. This invention seeks to provide a more economical construction for attic fans, wherein the cast hub and the large pulley or sheave on the blade shaft may be eliminated.

SUMMARY OF THE INVENTION

According to the invention, an attic fan structure is provided which is economical and of simple design, yet which is entirely dependable and sturdy in use. The structure includes a flat box-like housing or frame having an upturned rim around a large central opening, as in conventional attic fans. The fan structure has no central hub. Instead, the blades are bent at their inner ends to form oppositely disposed flanges which are riveted, or may be bolted, to upper and lower circular metal discs or plates. The blades and discs together form an unitary structure which eliminates the need for the hub. The blade structure is affixed around a stationary non-rotative shaft by bearings which are disposed in circular upset formations of the discs. The bearings are held in place on the stationary shaft by set screws. The upper disc has an upturned circular flange therearound which serves as a pulley, so that the relatively expensive pulley of conventional attic fans is also eliminated. A drive motor having its shaft vertically disposed is mounted on the frame or housing outside of the central opening and has a small pulley on its shaft to engage the belt. The structure is considerably more simple than that of conventional attic fans, and is consequently substantially more economical to manufacture.

A principal object of the invention is to provide attic fans having an improved design, which are economical yet which are entirely dependable in use. A further object of the invention is to provide such attic fans which require no central hub and in which the blade shaft pulley or sheave is eliminated. Yet another object of the invention is to provide such attic fans wherein the blades together with upper and lower plates or discs form a unitary structure which is rotatively disposed about a stationary central shaft. Still another object of the invention is to provide such attic fan structures which are light in weight and may be more easily handled and installed than conventional attic fans.

Other objects and advantages of the invention will appear from the following detailed description of a preferred embodiment, reference being made to the accompanying drawings.

BRIEF DESCRIPTIONS OF THE DRAWINGS

FIG. 1 is an upper plan view of an attic fan of preferred form according to the invention.

FIG. 2 is a side elevation of the attic fan shown in FIG. 1.

DESCRIPTION OF THE PREFERRED EMBODIMENT

Figure 3:
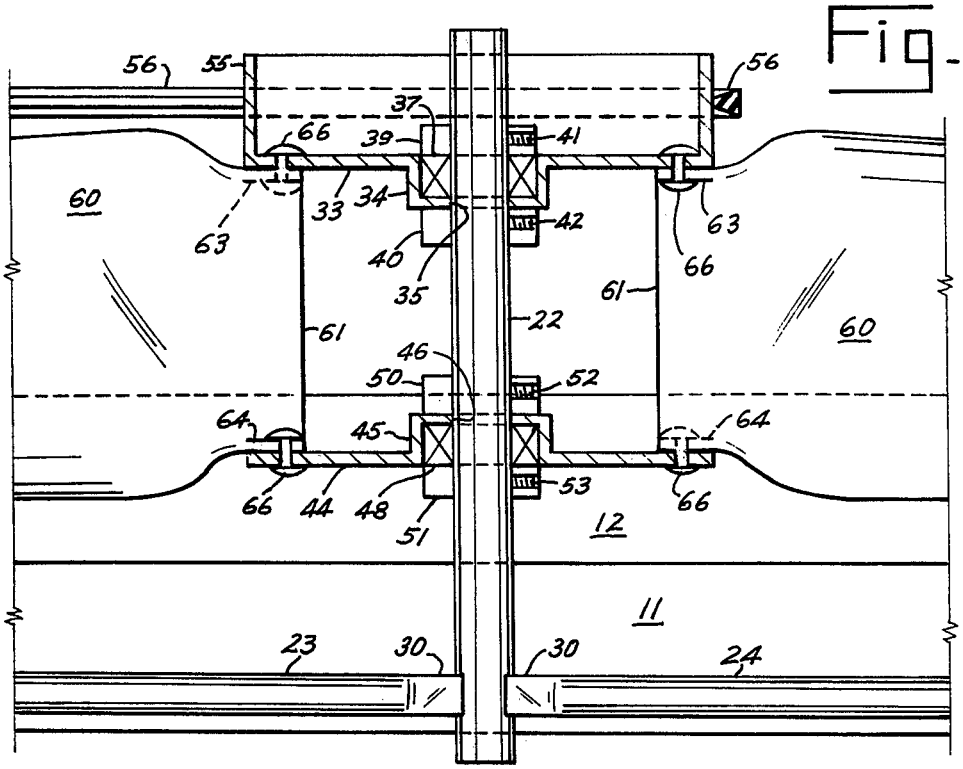
FIG. 3 is an enlarged partial vertical cross section of the attic fan shown in FIG. 1, taken at line 3—3 of FIG. 1.
Figure 4:
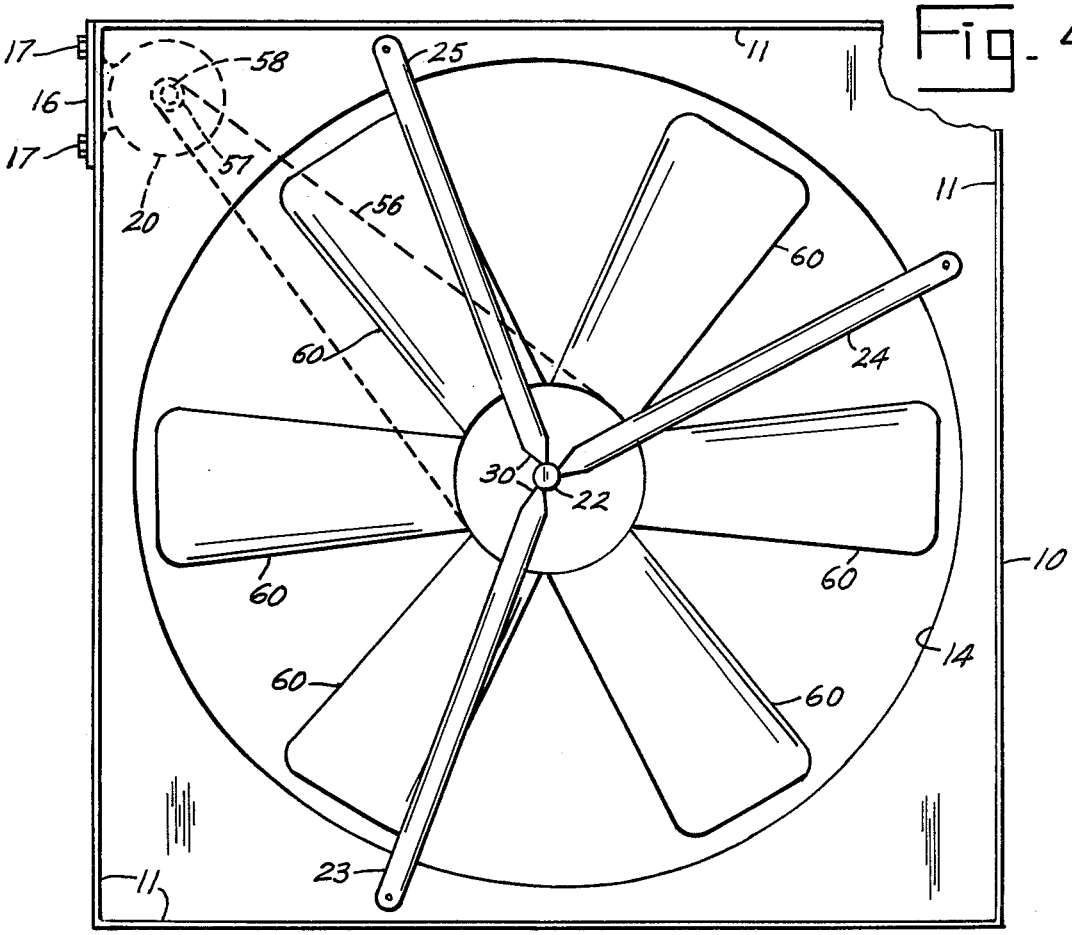
FIG. 4 is a bottom view of the apparatus shown in FIG. 1.

Referring now to the drawings in detail, a preferred embodiment of apparatus according to the invention will now be described. A frame or housing 10 is formed of sheet metal, such as steel, and has a downturned flange 11 around its outer edges. The flange 11 is intended to be wrapped around a square wood frame around a ceiling opening of a house or building structure in which the attic fan is to be installed. An upwardly curved flange or lip 12 surrounds a large central opening 14 in housing 10. Opening 14 is centered in the horizontal plate portion 15 of the housing as shown. An upstanding plate 16 is secured to flange or rim 11 by bolts 17. The base 19 of electric motor 20 is secured to plate 16 by bolts disposed through suitable openings of plate 16 and base 19, the bolts not being shown in the drawing but the motor connection to the plate being conventional.

The sheet metal parts shown in the drawing are shown somewhat thicker than their actual thicknesses, for clarity of the drawings, the sheet metal being of sufficient thickness to bear the loads inherent in the design.

A stationary vertical shaft 22 is supported by three radial bars 23, 24, 25. The outer end of each bar is flat as at 27, and is bolted to a vibration eliminating isolation type connector 28 as shown. The upper end of each connector 28 is secured by a bolt or screw 29 to plate 15. Each isolation connector 28 has upper and lower parts separated by rubber or other elastomeric material so that vibrations are not transmitted between bars 23–25 and housing 10. The inner end of each bar 23–25 is welded to shaft 22, the inner ends of the rods 23–25 being swedged into a vertical shape at 30. The vertical inner forms of the rods provide sufficient stability of shaft 22 as very secure welds may be made with this configuration.

Referring now especially to FIG. 3, upper disc 33 has a cylindrical upset portion 34 at its center. Circular opening 35 at the center of the upset formation has shaft 22 disposed therethrough. A bearing 37 is disposed within formation 34, the bearing and disc 33 being affixed to the shaft by upper and lower collars 39, 40 secured by set screws 41, 42 respectively. Lower disc 44 has upwardly disposed central upset formation 45 having central opening 46 through which stationary shaft 22 is disposed. Bearing 48 is disposed around the shaft in upset formation 45, the assembly being secured to shaft 22 by collars 50, 51 anchored in place by set screws 52, 53, respectively. As will be understood, the discs 33, 44 are rotative with respect to shaft 22 but may not move vertically therealong. The four set screws 41, 42, 52, 53 securely hold the discs 33, 44 in place longitudinally of the shaft 22, and the bearings 37, 48 permit the disc rotations.

Upper disc 33 has upwardly depending circular flange 55 around its edge. A single stamping die may be used to make both discs 33 and 44, which are the same except for flange 55, this reducing the cost of manufacture. A drive belt 56 is disposed around flange 55 and around a sheave or pulley 57 disposed on shaft 58 of motor 20. Motor 20 has suitable electrical connections for operation which are not shown in the drawings.

Still referring especially to FIG. 3 of the drawings, but to the other drawings as well, each blade 60 has a straight inner end 61. Referring to the blade 60 at the right hand side of FIG. 3, the blade is inclined toward the viewer upwardly and has a flange 63 directed toward the viewer at its upper side. Flange 64 is directed away from the viewer at its lower edge. Flange 63 is secured to the disc 33 by rivets 66, two rivets 66 usually being used. Lower flange 64 is similarly secured to disc 44 by two rivets 66. Referring now to the blade 60 at the left hand side of FIG. 3, the blade is inclined toward the viewer downwardly and again upper flange 63 is secured to disc 33 by two rivets 66 and lower flange 64 is similarly secured to lower disc 44. Since the blades 60 and the discs 33, 44 are sufficiently stiff, the blade-disc structure is rigid and strong. In this way, the usual hub which is a cast structure and relatively expensive which is universally found in other attic fans is not needed. The described structure is very strong and serviceable yet is much lighter in weight than that in the conventional attic fan.

By providing that the belt 56 engages around flange 55 of upper disc 33, the relatively heavy and expensive sheave or pulley of conventional attic fans is done away with, this both further reducing the cost of the attic fans and making them lighter in weight. As will be understood, the blades are of the same inclination around the central stationary shaft 22, so that when motor 20 is operated the blades will be rotated to drive air in an upward direction through opening 14. Of course, if desired, the blade inclinations may be the opposite of that described to drive air downwardly through openings 14. The rods or bars 23–25 are shorter and lighter in weight than the hub and shaft supporting bars of conventional attic fans, and further make the described attic fan structures more economical and lighter in weight. Further, the rods are straight and are stronger than the supporting bars of conventional fans. The described attic fans have six blades 60 instead of the conventional four blades, and are more efficient and are quieter in operation.

While a preferred embodiment of the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Fan apparatus, comprising a plurality of identical radially disposed equally circularly spaced elongate angular fan blades each having radially disposed opposite longitudinal edges, a stationary central shaft, first and second spaced plates each disposed substantially perpendicular to said shaft and rotatably fixed to said shaft, the inner end of each said fan blade extending angularly between said first and second plates and being connected to said first plate at the radially inner end of one of its said longitudinal edges and being connected to said second plate at the radially inner end of the other of its said longitudinal edges, and each said fan blade extending radially outward of said plates beyond said connections, one of said plates having means at its side opposite said connections of said inner ends of said longitudinal blade edges thereto for engagement by a drive belt disposed therearound to rotate said plates and blades about said shaft.

2. The combination of claim 1, said means for engagement by a drive belt comprising a cylindrical flange concentric with said shaft depending from said one of said plates.

3. The combination of claim 2, said plate having said means for engagement by a drive belt being circular and said cylindrical flange being formed around its outer edge.

4. The combination of claim 2, each said plate being cylindrical concentric with said stationary shaft, said circular flange being formed around the outer edge of one of said plates.

5. The combination of claim 1, each said plate being circular and concentric with said stationary shaft.

6. The combination of claim 5, said means for engagement by a drive belt comprising a cylindrical flange carried by one of said circular plates.

7. The combination of claim 6, said cylindrical flange being formed around the edge of said one of said circular plates.

8. The combination of claim 1, each said plate being circular and concentric with said stationary shaft, said means for engagement by a drive belt comprising a cylindrical flange formed around the edge of one of said circular plates, each said circular plate having a bearing means at its center engaged with said shaft, and collar means adjacent each said bearing means and surrounding said shaft adapted to be releasably fixed to said shaft for fixing each said bearing means to said shaft lengthwise thereof.

9. The combination of claim 8, each said plate having a concentric cylindrical upset axially of said shaft, and said bearing means being disposed therein.

10. The combination of claim 9, a said collar means being disposed at each side of each said bearing means.

11. The combination of claim 9, including a housing surrounding the outer ends of said blades, and rod means depending from said housing supporting said shaft.

12. The combination of claim 11, said rod means being radially disposed with respect to said shaft and being positioned whereby only one of said rod means is in a position substantially coincident with the rotative position of a said blade at any time in order that plural vibration effects caused by plural blades passing rods at the same time will not occur.

13. The combination of claim 12, including motor means supported by said housing having a drive shaft parallel with said shaft, said drive shaft having a sheave fixed thereon, and drive belt means engaged around said sheave and said cylindrical flange.

14. The combination of claim 13, including vibration damping means connecting each said rod means to said housing whereby vibrations resulting from rotation of said blades and transmitted to said housing are reduced.

15. The combination of claim 14, said housing having connection means around its outer periphery adapted for connection of the outer periphery of said housing, around an opening of a building structure.

16. The combination of claim 15, said connection means comprising a flange and said housing including a plate portion perpendicular to said shaft from which said flange perpendicularly depends.

17. The combination of claim 16, said rod means being disposed at one side of said plate portion and said motor and drive belt being disposed at the opposite side of said plate portion.

18. The combination of claim 17, said plate portion of said housing being rectilinear and having a circular opening having its surrounding edge closely spaced from the outer ends of said blades.

19. The combination of claim 18, said surrounding edge of said circular opening being flared in one direction transverse to said plate portion.

* * * * *